US007010888B2

(12) United States Patent
Tumlin et al.

(10) Patent No.: US 7,010,888 B2
(45) Date of Patent: Mar. 14, 2006

(54) MOLDED SNAP-TOGETHER FRAME

(75) Inventors: Ricky W. Tumlin, Acworth, GA (US); J. Larry Underwood, Woodstock, GA (US)

(73) Assignee: L.L. Culmat, L.P., Woodstock, GA (US)

( * ) Notice: Subject to any disclaimer, the term of this patent is extended or adjusted under 35 U.S.C. 154(b) by 113 days.

(21) Appl. No.: 10/373,155

(22) Filed: Feb. 24, 2003

(65) Prior Publication Data

US 2004/0083678 A1 May 6, 2004

Related U.S. Application Data

(60) Provisional application No. 60/423,133, filed on Nov. 1, 2002.

(51) Int. Cl.
*E04B 3/96* (2006.01)

(52) U.S. Cl. ..... 52/204.56; 52/2.3; 52/204.69; 52/204.7

(58) Field of Classification Search ..... 52/718.02, 52/718.03, 718.04, 718.05, 718.06, 455, 52/213, 505, 581, 580, 591.2, 656.5, 204.62, 52/208.56, 214, 204.6, 204.07, 204.69, 207.4, 52/204.5, 204.597, 717.01, 205
See application file for complete search history.

(56) References Cited

U.S. PATENT DOCUMENTS

| | | | | |
|---|---|---|---|---|
| 2,645,827 A | | 7/1953 | Koll | |
| 3,432,897 A | | 3/1969 | Baumgartner | |
| 3,455,080 A | | 7/1969 | Meadows | |
| 3,712,005 A | | 1/1973 | Eschbach et al. | |
| 3,750,358 A | * | 8/1973 | Lewkowitz | 52/204.597 |
| 3,760,543 A | * | 9/1973 | McAllister | 52/204.591 |
| 3,881,290 A | | 5/1975 | Bouchey | |
| 3,903,669 A | * | 9/1975 | Pease et al. | 52/455 |
| 3,939,620 A | | 2/1976 | Bero | |
| 3,975,881 A | | 8/1976 | Ninowski, Jr. | |
| 4,040,219 A | | 8/1977 | Budich | |
| 4,184,297 A | | 1/1980 | Casamayor | |
| 4,370,828 A | | 2/1983 | Miro | |
| 4,407,100 A | | 10/1983 | Huelsekopf | |
| 4,539,243 A | | 9/1985 | Miller | |
| 4,852,312 A | | 8/1989 | Harbom | |
| 5,090,168 A | | 2/1992 | Fast et al. | |
| 5,133,168 A | * | 7/1992 | Neilly et al. | 52/204.5 |
| 5,187,867 A | | 2/1993 | Rawlings | |
| 5,233,802 A | * | 8/1993 | Rogers | 52/212 |
| 5,249,403 A | | 10/1993 | Neilly et al. | |
| 5,325,633 A | | 7/1994 | Magoon | |
| 5,365,707 A | | 11/1994 | Jones et al. | |

(Continued)

*Primary Examiner*—Ramon O Ramirez
(74) *Attorney, Agent, or Firm*—Brinks Hofer Gilson & Lione

(57) ABSTRACT

A frame assembly is formed of two molded sub-assemblies, each sub-assembly being identical to the other. Each sub-assembly has a perimeter wall having an inner surface facing an opening and an outer surface to face a edge of an aperture in a partition. A first edge of the wall confronts a surface of the window while a flange projects outward from the outer surface of the perimeter wall. A plurality of joining elements are fixed to and project normally from the flange. Each joining element includes an alignment element and a locking surface to engage a similar surface on an aligned joining element of a confronting sub-assembly. The joining elements are arranged in a pattern that permits any two sub-assemblies made in the same mold to be permanently snapped together without the use of any separate fasteners.

31 Claims, 3 Drawing Sheets

U.S. PATENT DOCUMENTS 5,369,922 A 12/1994 Hansen
5,555,684 A 9/1996 Galowitz et al.
5,570,548 A 11/1996 Hopper
5,577,355 A 11/1996 Leonelli
5,596,852 A 1/1997 Schiedegger
5,644,881 A 7/1997 Neilly
5,655,346 A 8/1997 Holmes et al.
5,692,349 A 12/1997 Guillemet
5,771,640 A 6/1998 Back
5,836,119 A 11/1998 Emmanuel
5,836,125 A * 11/1998 Regina ..... 52/306
5,839,234 A 11/1998 Mayer
5,913,786 A 6/1999 Mayer
6,047,514 A 4/2000 Verch
6,101,772 A 8/2000 Leonard et al.
6,151,849 A * 11/2000 Twigg et al. ..... 52/208
6,209,269 B1 4/2001 Valderrama
6,244,000 B1 6/2001 Bertolami
6,272,801 B1 8/2001 Suh
6,378,931 B1 4/2002 Kolluri et al.
6,467,226 B1 * 10/2002 Dodson et al. ..... 52/220.1
6,553,735 B1 * 4/2003 Wang Chen ..... 52/455
6,694,701 B1 * 2/2004 Wang et al. ..... 52/783.1
2003/0056442 A1 * 3/2003 Gerard
2004/0068942 A1 * 4/2004 Krochmal et al.

* cited by examiner

MOLDED SNAP-TOGETHER FRAME

CROSS-REFERENCE TO RELATED APPLICATIONS

This application is related to and claims all available benefits from U.S. Provisional Application Ser. No. 60/423,133, filed Nov. 1, 2002, which is hereby incorporated by reference in its entirety

BACKGROUND OF THE INVENTION

The present invention relates to windows and other architectural elements that are coupled into a aperture in a partition by a surrounding frame. The present invention relates particularly to frame structures for such windows that are intended to capture a portion of the partition as well as the window between two confronting frame sub-assemblies.

In many situations it is desirable to mount a window or other planar segment within an aperture in a wall, panel, or other partition. An example is the mounting of windows in panel doors such as garage doors, or other normally solid doors. Another example is the mounting of vents in the solid walls of trailers or campers.- Still another example is the mounting of displays within apertures in solid panels.

In any of these applications the frames for holding the window or other structure within the aperture of the panel must be rugged and easy to assemble. In many instances, low cost is especially important. In some manufacturing situations, speed of assembly is also quite important as is minimizing the variety of inventory necessary to achieve the desired structure. In some other applications a pleasing or decorative appearance is essential. Unfortunately, there are many drawbacks in the conventional devices commonly employed for the installation of windows and the like within solid panels.

Koll, U.S. Pat. No. 2,645,827 discloses a frame requiring a complex cut-out in order to accommodate a plurality of tongues which are used to hold a mounting frame to the surrounding panel. As a result, the mounting of windows using this system is time-consuming and difficult. Further, if the precise pattern and the notches is not achieved, substantial difficulties can develop.

Hansen, U.S. Pat. No. 5,369,922 discloses a two-piece frame using a simple aperture cut out pattern, thereby avoiding the drawbacks of the Koll device. The Hansen frame has a first frame member including a plurality of pairs of ribs connected by a strip to form elongated openings. A second frame includes elongated tongues having serrations arranged in a longitudinal direction around the frame. The two frames clip together from opposite sides of the wall or panel in which the window or other structural element is to be mounted. The second frame, and the side teeth on each tongue cooperate with the teeth on a complementary or confronting pair of ribs on the first frame to hold the two frames together. The strength of this arrangement is that it is highly tamper resistant. However, the two frames of Hansen require being molded in two different molds. It is not possible to clip two of the first frame members together from opposite sides of the wall or panel, nor is it possible to clip two of the second frame members together from opposite sides of the wall or panel. The Hansen frame must be formed from the combination of one first frame and one second frame.

Leonelli, U.S. Pat. No. 5,577,355 discloses a window frame formed of first and second frame pieces, which are generated from a single extrusion and then separated at a bridge extending between the frame pieces. Each frame piece produced in this manner has its own bridge part. The first frame piece is provided with a side recess aligned with its bridge part to receive fasteners for mechanically securing the two frame pieces to one another from opposite sides of a window pane through the respective bridge parts of the first and second frame pieces. While a frame constructed according to the disclosure of Leonelli requires only a single mold, the frame is an extruded section that must be cut and assembled from a number of pieces. Additionally the frame of Leonelli requires the use of separate fasteners and the head of the fasteners must be hidden using a separately molded recess covering strip.

Neilly, U.S. Pat. No. 5,644,881 discloses a window frame assembly having a pair of injection molded window frame halves each including a plurality of screw bosses intended to receive screw fasteners. The screw bosses are arranged to align in male/female pairs when the frame halves are brought together in proper alignment. The mating male and female screw bosses are frictionally fitted together to releasably secure the frame halves during storage, transportation, and installation. To complete the installation, screw fasteners are inserted through the mating male and female screw bosses so that the mating pairs are no longer separable. There is no provision in the Neilly disclosure for the completion of an installation without the use of screw fasteners. There also no suggestion in Neilly that the pair of injection molded window frame halves could be made with a single mold. There is no suggestion in Neilly that two of the first frame members might be secured together from opposite sides of the wall or panel, or that two of the second frame members might be secured together from opposite sides of the wall or panel, using the frictionally fitted screw bosses.

Leonard, et al. U.S. Pat. No. 6,101,772 discloses a two-piece frame using a first frame and second frame. The first frame has a base structure and a plurality of connector studs extending substantially perpendicular to the base structure. Each of the connector studs has a hook structure extending perpendicular to a major plane of the connector stud. The second frame is formed by a substantially U-shaped channel member having, in cross-section, two capital portions. The capital portions of the second frame can overlap either the window or the wall in which the window is mounted. The second frame also has a plurality of apertures arranged on the arms to receive the hook structures on the ends of the connector studs. When coupled together, the connector studs of the first frame extend between the window and the wall in which the window is mounted to engage the apertures in the second frame. When so engaged, a deflection of the capital portions of the u-shaped second frame members exerts a spring-like pressure against the window and the wall in which the window is mounted. However, the two frames of Leonard, et al., require being molded in two different molds. It is not possible to clip two of the first frame members together from opposite sides of the wall or panel, nor is it possible to clip two of the second frame members together from opposite sides of the wall or panel. The Leonard, et al., frame must be formed from the combination of one first frame and one second frame.

There is still a need for a frame formed of two parts and can be easily assembled together, avoiding the use of separate fasteners, from opposite sides of the wall or panel in which a window or other architectural element is sought to be installed, yet can be formed in a single mold thereby reducing capital costs involved in the production of the frames.

SUMMARY OF THE INVENTION

This need is satisfied by a frame assembly of the present invention. The frame assembly is formed of two molded sub-assemblies, each sub-assembly being identical to the other. Each sub-assembly includes a wall defining a perimeter around an opening, the wall having an inner surface facing the opening and an outer surface adapted to face a edge of an aperture in a partition in which a window or other architectural element is to be installed. A first edge joins the inner and outer surfaces of the wall of each sub-assembly, the first edge being adapted to confront one surface of the window or other architectural element. A flange projects outward from the outer surface of the perimeter wall having a first surface joining a second edge of the wall inner surface that forms the dominant visual portion of the frame. The flange also has a second surface opposite the first surface that joins the perimeter wall outer surface. A plurality of joining elements are fixed to and project normally from the second surface of the flange. Each of the joining elements including an alignment element for aligning confronting joining elements of two confronting sub-assemblies. Each of the joining elements also includes a locking surface adapted to engage a similar locking surface on an aligned joining element of a confronting sub-assembly. The joining elements are arranged around the outer surface of the perimeter wall in a pattern that permits any two sub-assemblies made in the same mold to be permanently snapped together from opposite sides of the partition or panel in which a window or other architectural element is sought to be installed without the use of any separate fasteners.

The frame sub-assemblies of the present invention employ alignment elements that assure the proper coupling of the joining elements when two of the sub-assemblies are pressed together in a confronting relationship. The alignment elements can be in the form of a first element having a projecting distal end and a confronting second element including a cavity sized to receive the projecting distal end of the first element. The projecting distal end of the first alignment element can include an enlarged portion supported by a flexible portion allowing some relative lateral movement between joining elements of the confronting sub-assemblies, yet biasing the joining elements into engagement to assure the permanent retention of two sub-assemblies to each other when once joined in a confronting relationship. The alignment elements can be included as an integral portion of the joining elements. The alignment elements can also include a plurality of panel locating members including distal ends projecting beyond and outside of the first edge of perimeter wall to locate the windowpane unit or other architectural element in relation to the frame assembly. A plurality of positioning tabs can also be included on each of the frame sub-assemblies, each tab having an outer surface adapted to be received within the aperture in the partition in which the window or other architectural element is to be installed for positioning the subassembly with respect to the partition aperture.

One feature of the present invention is the selected arrangement of alignment elements and joining elements around the outside of the perimeter wall so that two identical sub-assemblies can be joined together permanently by merely positioning the two sub-assemblies in a confronting relationship on opposite sides of a partition aperture and a desired architectural element, and pressing the two sub-assemblies together. The alignment elements assure proper alignment of the sub-assemblies so that the architectural element is suitably captured at the desired location within the partition aperture. The alignment elements also assure a retaining engagement is achieved between the joining elements so that the frame assembly and the architectural element, such as a window, is permanently retained in the partition aperture without need for any separate fasteners of any kind. This feature has the advantage of allowing very quick assembly of framed windows and other elements into partition apertures, particularly in assembly line situations.

Another feature of the present invention is the selected arrangement of alignment elements and joining elements around the outside of the perimeter wall so that a frame assembly of the present invention can be constructed from two sub-assemblies formed in the same mold. Thus only one mold need be made to form all the necessary parts for the formation of a complete frame assembly. This single mold origin of the two sub-assemblies lowers the capital costs that are involved in the mold necessary to form the sub-assemblies of the present invention. The single mold origin of the two sub-assemblies also eliminates any mold-to-mold discrepancies that can contribute to part mismatch. It will be appreciated that in some circumstances, this same mold origin feature might be omitted when the first surfaces of the outwardly extending flanges are desirably of a different appearance, as changes in appearance of the first surfaces of the outwardly extending flanges are a matter of design choice, but the structural relationships of the present invention can still be used in such situations.

Further features and advantages of the invention will become apparent to those skilled in the art from the following discussion of the preferred embodiments as depicted in the accompanying drawings.

DESCRIPTION OF THE ILLUSTRATED PREFERRED EMBODIMENTS

Figure 1:
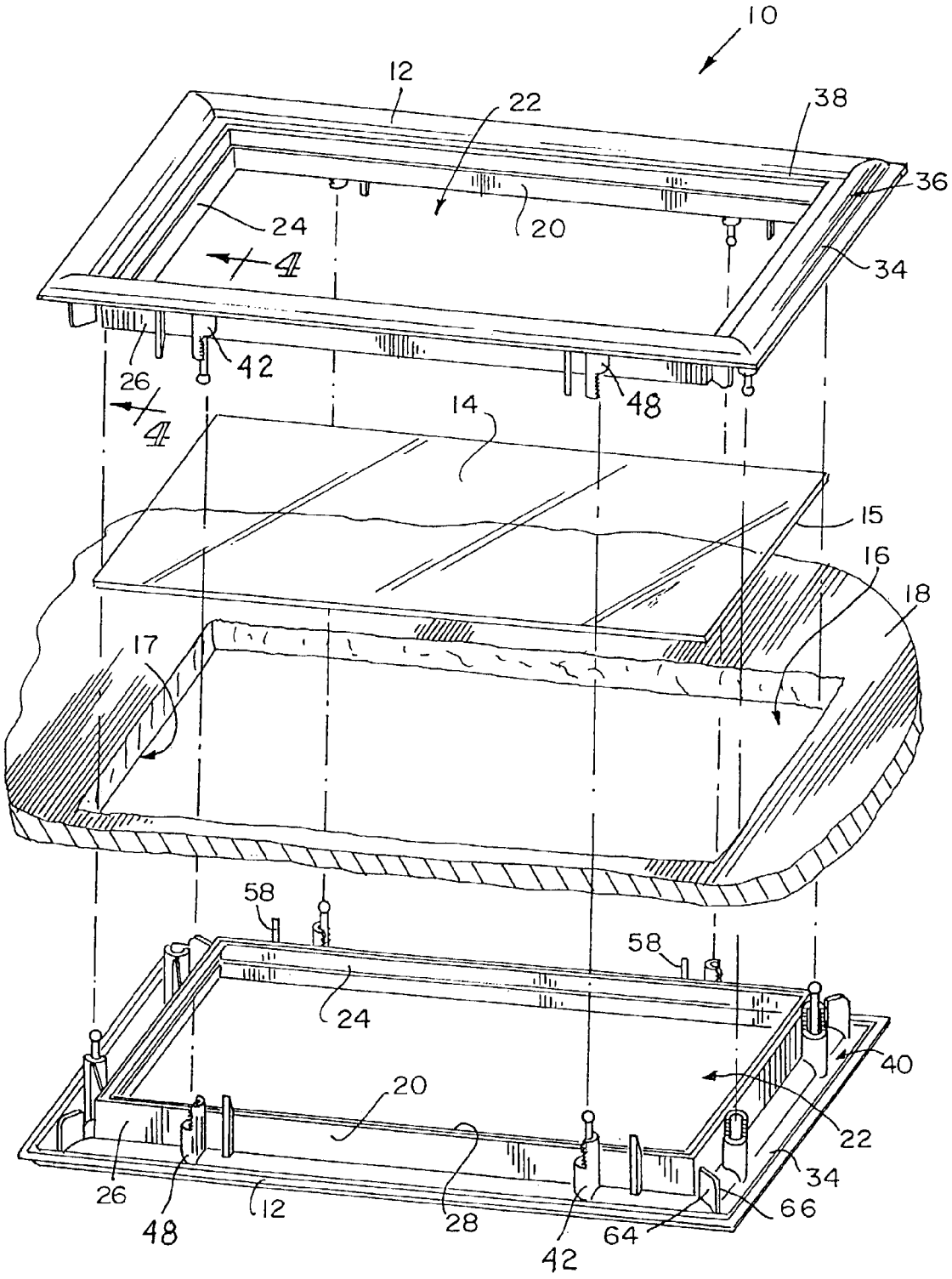
FIG. 1 is an exploded perspective view of a frame assembly of the present invention employing two identical sub-assemblies.

A frame assembly 10 of the present invention, shown in FIGS. 1–5 employs two identical sub-assemblies 12 placed in confronting relationship to each other on opposite sides of an architectural element 14 for incorporation into an aperture 16 in a partition 18. The illustrated architectural element 14 is a windowpane unit, but it will be appreciated by those skilled in the art that other architectural elements, such as vents or decorative panels and other devices, can be substituted for the windowpane unit without departing from the spirit of the present invention. The frame assembly 10 is illustrated to be rectangular, but it will be appreciated by those skilled in the art that other shapes for the frame assembly 10 and the corresponding aperture 16 can be accommodated by the present invention such as circular, square, octagonal, oval, and so forth. The partition 18 can be in the form of a fixed wall, a door, a divider, a partition or any other static or movable structural barrier in which another architectural element 14 is to be incorporated together with a frame 10 outlining the architectural element 14.

Figure 2:
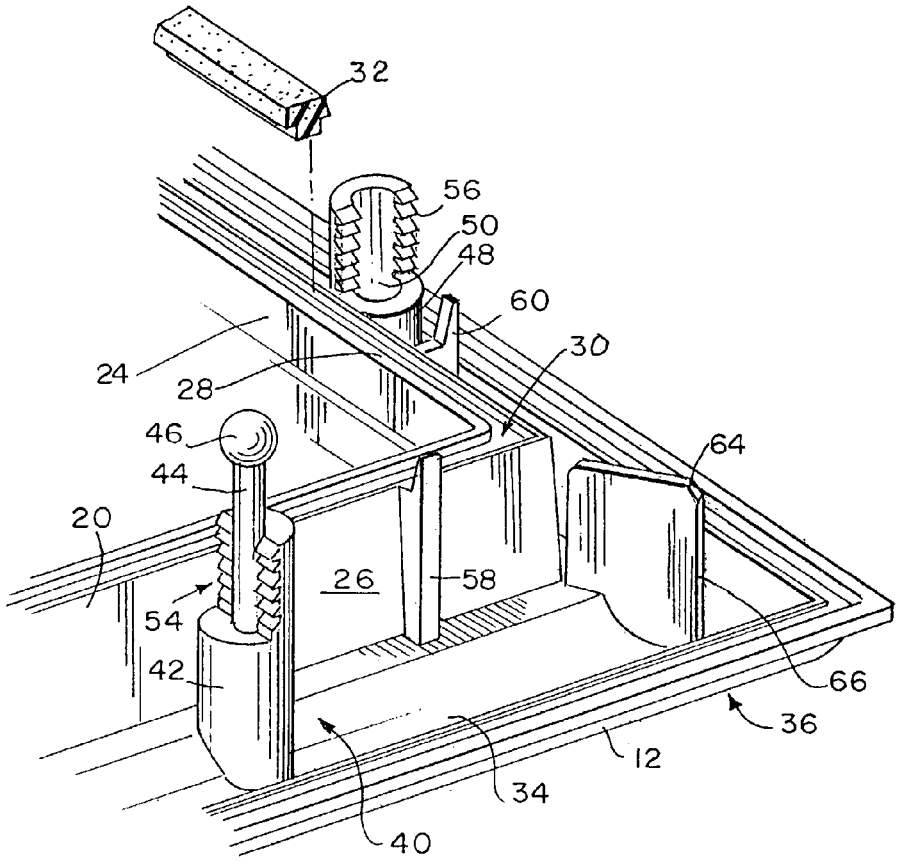
FIG. 2 is a perspective detail view of one corner of a sub-assembly of the present invention showing a first embodiment of an alignment element.
Figure 3:
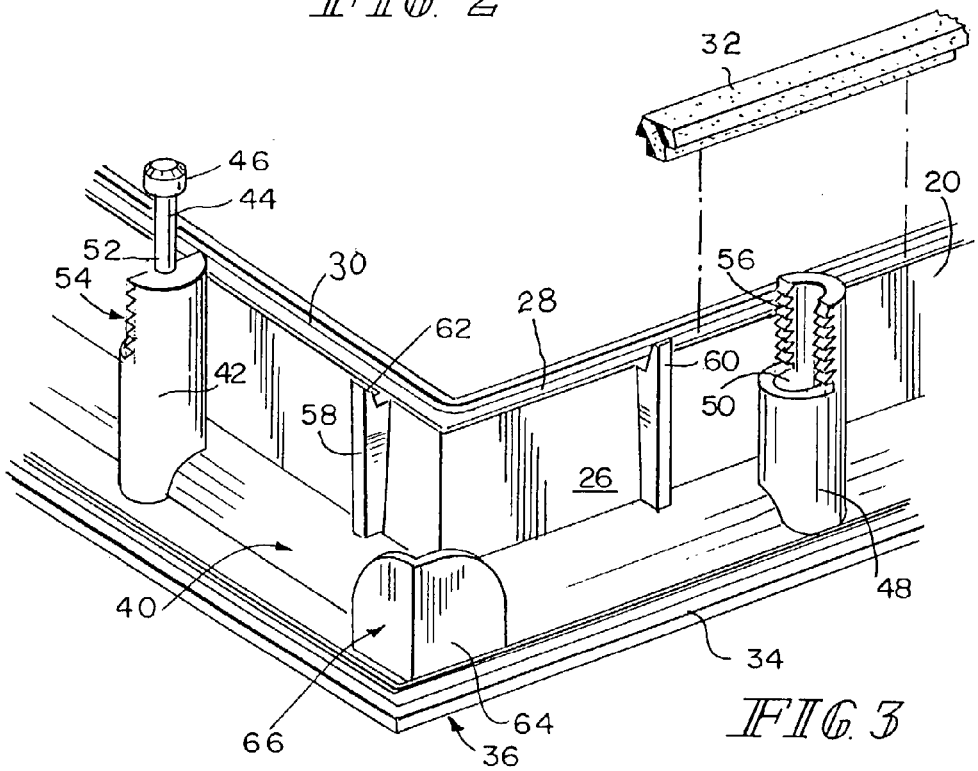
FIG. 3 is a perspective detail view of another corner of a subassembly showing another embodiment of an alignment element of the present invention.
Figure 4:
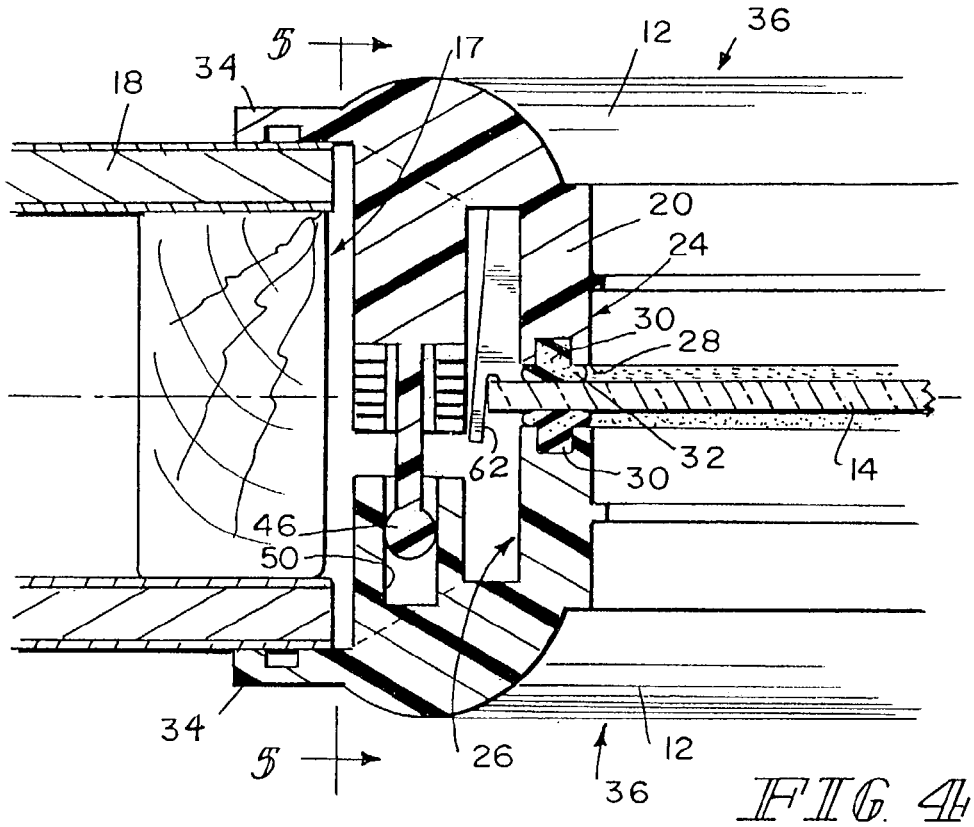
FIG. 4 is a partial sectional view taken along line 4—4 of FIG. 1 of a frame assembly employing the alignment elements of FIG. 2 in relation to a partition in which the frame is installed.

Each sub-assembly 12 is shown in FIG. 1 to include a wall 20 defining a perimeter around an opening 22 that is generally of the same shape but somewhat smaller than the aperture 16 in partition 18 into which the sub-assembly 12 is to be positioned. The perimeter wall 20 has an inner surface 24 facing the opening 22 and an outer surface 26 adapted to face an edge 17 of the aperture 16 in the partition 18. A wall first edge 28 joins the inner and outer surfaces 24 and 26. As shown in FIGS. 2–4, the wall first edge 28 includes a groove 30 adapted to include a soft cushion element 32, which can be adhesive in character, that is adapted to contact one surface of the window or other architectural element 14. A flange 34 projects outward from the outer surface 26 of the perimeter wall 20. The flange 34 has a first surface 36 that constitutes a major visible portion of the frame 10 once the frame is installed in the partition aperture 16. The flange first surface 36 joins a second edge 38 of the wall inner surface 24. The flange 34 also has a second surface 40 opposite the first surface 36 that joins the perimeter wall outer surface 26.

A plurality of joining elements 42 are fixed to and project normally from the second surface 40 of the flange 34. As shown in FIG. 1, the joining elements 42 are positioned on the second surface 40 on each frame sub-assembly 12 so as to project toward corresponding joining elements 48 of the confronting frame sub-assembly. The joining elements 42 include alignment elements 44 as shown in FIGS. 2–4. The alignment elements 44 include a projecting distal end 46. Each of the joining elements 48 includes a cavity 50 sized to receive a projecting distal end 46 of a confronting joining element 42. The projecting distal ends 46 can be in the shape of a ball as shown in FIG. 2. The projecting distal ends 46 can also be in the shape of a tapered cylinder as show in FIG. 3. Generally, the projecting distal end 46 should have a shape that will facilitate the mating of the projecting distal end 46 into the cavity 50 of the confronting joining element 48. The projecting distal ends 46 are supported by a flexible stem portion 52 that allows some relative lateral movement between joining elements 42 and 48 during the assembly of the confronting sub-assemblies to the position shown in FIGS. 4 and 5. While the distal end 46 is received in the confronting cavity 50, some limited relative lateral movement between the sub-assemblies is still possible to accommodate small dimensional errors in the size or shape of the inside wall 17 of the opening 16 in partition 18.

Figure 5:
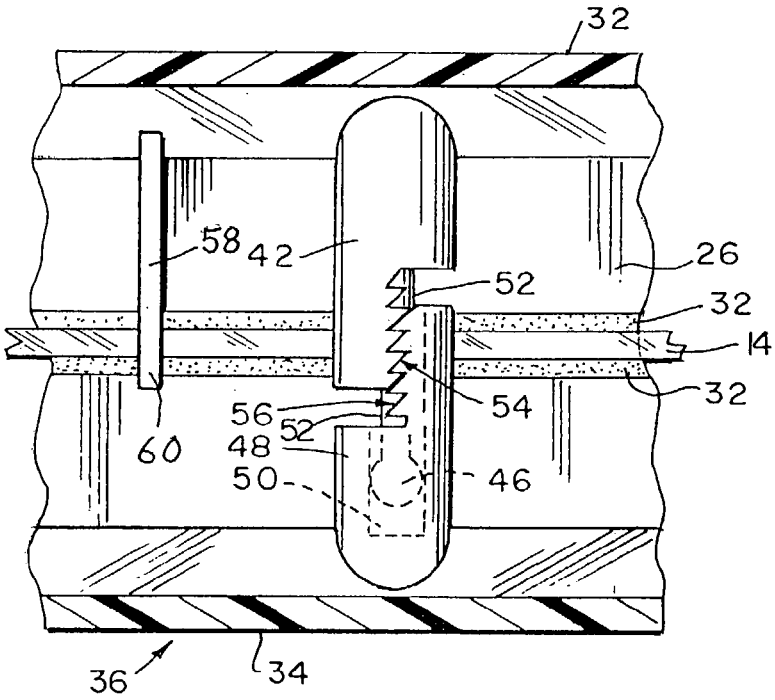
FIG. 5 is a sectional view taken along line 5—5 of FIG. 4 showing the engagement of the alignment elements upon assembly.

The joining elements 42 also include locking surfaces 54 adapted to engage a similar locking surface 56 on an aligned joining element 48 of the confronting sub-assembly. The locking surfaces 54 and 56 are generally complementary and have greater resistance to relative movement in one direction. That is, the shape of the locking surfaces 54 and 56 should be formed to permit easy assembly of two confronting sub-assemblies, but preferably the shape of the locking surfaces 54 and 56 should resist the disassembly of the sub-assemblies once they are joined together. A preferred shape for the locking surfaces 54 and 56 is a row of serrated or saw-shaped teeth on each side of the alignment element 44 as shown in FIGS. 2, 3 and 5.

A plurality of panel locating members 58 are also provided to locate the windowpane or other architectural element 14 in relation to the surface 28 of the frame sub-assemblies 12. The panel locating members 58 include distal ends 60 projecting beyond and outside of the first edge 28 of perimeter wall 20 including cushion element 32 extending from groove 30. The panel locating members 58 preferably include tapered internal surfaces 62 that directly interact with an outer edge 15 of the architectural element 14 to assure proper alignment of the element 14 with the sub-assemblies 12 as shown in FIG. 4.

A plurality of positioning tabs 64 are preferably included on each of the frame sub-assemblies 12. Each tab 64 has an outer surface 66 adapted to be received within the aperture 16 in the partition 18 in which the window or other architectural element 14 is to be installed. The outer wall 66 of each tab 64 interacts with surface 17 of the partition 18. The positioning tabs 64 can have the form of a planar element as shown in FIGS. 1 and 2. The positioning tabs 64 can also have the form of an angular element as shown in FIG. 3. The positioning tabs 64, regardless of form, preferably interact with the corners of the inside surface 17 of the partition 18 so as to self position the sub-assembly 12 with respect to the partition aperture 16.

The arrangement of the joining elements 42 and 48 around the outside of the perimeter wall 20 is such that two identical sub-assemblies 12 can be joined together permanently by merely positioning the two sub-assemblies in a confronting relationship on opposite sides of a partition aperture 16 and a desired included architectural element 14, and pressing the two sub-assemblies 12 together. The alignment elements 44 and 58 assure proper alignment of the sub-assemblies 12 so that the window or other architectural element 14 is suitably captured as shown in FIG. 4. The tabs 64 assure that the sub-assemblies 12 are assembled at the desired location within the partition aperture 16. The alignment elements 44 also assure a retaining engagement is achieved between the surfaces 54 and 56 of the joining elements 42 and 48 so that the frame assembly 10 and the architectural element 14 are permanently retained in the partition aperture 16 without need for any separate fasteners of any kind.

The alignment elements 44, 50 and 58 and joining elements 42 and 48 are arranged around the outside of the perimeter wall 20 so that a frame assembly 10 of the present invention can be constructed from two sub-assemblies 12 formed in the same mold. Thus only one mold need be made to form all the necessary parts for the formation of a complete frame assembly 10. This single mold origin of the two sub-assemblies 12 lowers the capital costs that are involved manufacturing the assemblies 10 of the present invention. Of course, this same mold origin feature might be omitted when the first surfaces 36 of the outwardly extending flanges 34 are desirably of a different appearance, as changes in appearance of the first surfaces 36 of the flanges 34 are a matter of design choice, but the structural relationships of the confronting portions of the present invention can still be used.

The foregoing description of the illustrated preferred embodiments is to be regarded as illustrative of the present invention, rather than limiting. The present invention is further identified in the following claims, including all equivalents, which are intended to define the spirit and scope of this invention.

What is claimed is:

1. A snap-together frame assembly having two confronting molded sub-assemblies, each sub-assembly being identical to the other and comprising:

a wall defining a perimeter around an opening, the wall having an inner surface facing the opening and an outer surface, a first edge joining the inner and outer surfaces of the wall, the first edge being adapted to confront a panel, a flange projecting outward from the outer surface of the wall, the flange having a first surface joining a second edge of the wall inner surface and a second surface joining the wall outer surface, and a plurality of joining elements fixed to and projecting normally from the second surface of the flange, each of the joining elements including an alignment element for aligning the joining elements of said two confronting sub-assemblies, and each of the joining elements including a locking surface comprising a row of serrated teeth on each side of the alignment element adapted to engage a similar locking surface on an aligned joining element of the confronting sub-assembly.

2. The snap-together frame assembly of claim 1 wherein the first edge joining the inner and outer surfaces of the wall includes a groove receiving a cushioning agent.

3. The snap-together frame assembly of claim 2 wherein the cushioning agent comprises an adhesive.

4. The snap-together frame assembly of claim 1 wherein the wall outer surface further comprises a plurality of panel locating members including distal ends projecting beyond and outside of the first edge.

5. The snap-together frame assembly of claim 4 wherein the panel locating members are asymmetrically positioned around the wall outer surface so as to avoid direct alignment with panel location members on said confronting sub-assembly.

6. The snap-together frame assembly of claim 1 wherein the flange second surface further includes a plurality of positioning tabs, each tab having an outer surface adapted to be received within an aperture in a partition for positioning the sub-assembly with respect to the partition.

7. The snap-together frame assembly of claim 6 wherein the positioning tabs are located at corners of the frame assembly.

8. The snap-together frame assembly of claim 1 wherein the alignment elements of the plurality of joining elements comprises a first set of joining elements including a projecting distal end and a second set of joining elements including a cavity sized to receive the projecting distal ends of the first set of joining elements of said confronting sub-assembly.

9. The snap-together frame assembly of claim 8 wherein the projecting distal end of the first set of joining elements includes an enlarged portion supported by a flexible portion allowing some relative lateral movement between joining elements of said confronting sub-assembly.

10. A snap-together window and frame assembly having two confronting molded sub-assemblies received within an aperture in a partition, the assembly comprising:

a first and second sub-assembly, each sub-assembly having a wall defining a perimeter around an opening, the wall having an inner surface facing the opening and an outer surface, a first edge joining the inner and outer surfaces of the wall, a flange projecting outward from the outer surface of the wall, the flange having a first surface joining a second edge of the wall inner surface and a second surface joining the wall outer surface and contacting said partition around said aperture, and a plurality of joining elements having a cylindrical shape fixed to and projecting normally from the second surface of the flange, a window pane unit sandwiched between the first edges of the confronting first and second sub-assemblies, a portion of the joining elements including an alignment element aligning the joining elements of the two confronting sub-assemblies, and each of the joining elements including a generally semi-cylindrical shaped extension having a locking surface comprising a row of serrated teeth on exposed edges of the joining element engaging a similar locking surface on an aligned joining element of the confronting sub-assembly so that the window pane unit is held by the frame assembly in the aperture in the partition.

11. The snap-together window and frame assembly of claim 10 wherein the first edge joining the inner and outer surfaces of the wall includes a groove containing a cushioning agent, the cushioning agent of at least one first edge comprising an adhesive bonding the groove to the window pane unit.

12. The snap-together window and frame assembly of claim 10 wherein the wall outer surfaces of at least one of the sub-assemblies further comprises a plurality of panel locating members including distal ends projecting beyond and outside of the first edge of the at least one of the sub-assemblies adjacent to a perimeter of the window pane unit.

13. The snap-together window and frame assembly of claim 10 wherein the flange second surface further includes a plurality of positioning tabs located at corners of the frame assembly, each tab having an outer surface adapted to be received within a aperture in a partition for positioning the sub-assembly with respect to the partition.

14. The snap-together window and frame assembly of claim 10 wherein the flange first surface of both the sub-assemblies are identical.

15. The snap-together window and frame assembly of claim 10 wherein the perimeter around the opening defines a square.

16. A sub-assembly of a snap-together frame assembly comprising: a wall defining a portion of a perimeter around an opening, the wall having an inner surface facing the opening and an outer surface, a first edge joining the inner and outer surfaces of the wall, the first edge being adapted to confront a panel, and a flange projecting outward from the outer surface of the wall, the flange having a first surface joining a second edge of the wall inner surface and a second surface joining the wall outer surface, and joining elements having a cylindrical shape fixed to and projecting from the flange second surface and comprising:

an alignment element for aligning the joining elements of two confronting sub-assemblies, and a locking surface comprising a row of serrated teeth on exposed edges of the joining element for engaging a similar locking surface on an aligned joining element of the confronting sub-assemblies.

17. The sub-assembly of claim 16 wherein the alignment elements comprise a first joining element including a projecting distal end and a second joining element including a cavity sized to receive the projecting distal end of the first joining element of said confronting sub-assemblies.

18. The sub-assembly of claim 17 wherein the projecting distal end of the first joining element includes an enlarged portion supported by a flexible portion allowing some relative lateral movement between joining elements of said confronting sub-assemblies.

19. A snap-together frame assembly having two confronting molded sub-assemblies, each sub-assembly being identical to the other and comprising:

a wall defining a perimeter around an opening, the wall having an inner surface facing the opening and an outer surface, a first edge joining the inner and outer surfaces of the wall, the first edge being adapted to confront a panel, a flange projecting outward from the outer surface of the wall, the flange having a first surface joining a second edge of the wall inner surface and a second surface joining the wall outer surface, and a plurality of joining elements fixed to and projecting normally from the second surface of the flange, each of the joining elements including an alignment element for aligning the joining elements of said two confronting sub-assemblies, and each of the joining elements including a locking surface adapted to engage a similar locking surface on an aligned joining element of the confronting sub-assembly, a first set of the joining elements including a projecting distal end and a second set of the joining elements including a cavity sized to receive the projecting distal ends of the first set of joining elements on a confronting sub-assembly, the projecting distal end of the first set of joining elements including an enlarged portion supported by a flexible portion allowing some relative lateral movement between joining elements of the confronting sub-assemblies.

20. The snap-together frame assembly of claim 19 wherein the first edge joining the inner and outer surfaces of the wall includes a groove receiving a cushioning agent.

21. The snap-together frame assembly of claim 20 wherein the cushioning agent comprises an adhesive.

22. The snap-together frame assembly of claim 19 wherein the wall outer surface further comprises a plurality of panel locating members including distal ends projecting beyond and outside of the first edge.

23. The snap-together frame assembly of claim 22 wherein the panel locating members are asymmetrically positioned around the wall outer surface so as to avoid direct alignment with panel location members on said confronting sub-assembly.

24. The snap-together frame assembly of claim 19 wherein the flange second surface further includes a plurality of positioning tabs, each tab having an outer surface adapted to be received within an aperture in a partition for positioning the sub-assembly with respect to the partition.

25. The snap-together frame assembly of claim 24 wherein the positioning tabs are located at corners of the frame assembly.

26. A snap-together window and frame assembly having two confronting molded sub-assemblies received within an aperture in a partition, the assembly comprising:

a first and second sub-assembly, each sub-assembly having a wall defining a perimeter around an opening, the wall having an inner surface facing the opening and an outer surface, a first edge joining the inner and outer surfaces of the wall, a flange projecting outward from the outer surface of the wall, the flange having a first surface joining a second edge of the wall inner surface and a second surface joining the wall outer surface and contacting said partition around said aperture, and a plurality of joining elements fixed to and projecting normally from the second surface of the flange, a window pane unit sandwiched between the first edges of the confronting first and second sub-assemblies, each of the joining elements including an alignment element aligning the joining elements of the two confronting sub-assemblies, a first set of the joining elements including a projecting distal end and a second set of joining elements including a cavity sized to receive the projecting distal ends of the first set of joining elements of a confronting sub-assembly, the projecting distal end of the first set of joining elements including an enlarged portion supported by a flexible portion allowing some relative lateral movement between joining elements of confronting sub-assemblies, and each of the joining elements including a locking surface engaging a similar locking surface on an aligned joining element of the confronting sub-assembly so that the window pane unit is held by the frame assembly in the aperture in the partition.

27. The snap-together window and frame assembly of claim 26 wherein the first edge joining the inner and outer surfaces of the wall includes a groove containing a cushioning agent, the cushioning agent of at least one first edge comprising an adhesive bonding the groove to the window pane unit.

28. The snap-together window and frame assembly of claim 26 wherein the wall outer surfaces of at least one of the sub-assemblies further comprises a plurality of panel locating members including distal ends projecting beyond and outside of the first edge of the at least one of the sub-assemblies adjacent to a perimeter of the window pane unit.

29. The snap-together window and frame assembly of claim 26 wherein the flange second surface further includes a plurality of positioning tabs located at corners of the frame assembly, each tab having an outer surface adapted to be received within a aperture in a partition for positioning the sub-assembly with respect to the partition.

30. The snap-together window and frame assembly of claim 26 wherein the flange first surface of both the sub-assemblies are identical.

31. The snap-together window and frame assembly of claim 26 wherein the perimeter around the opening defines a square.

* * * * *